US012434095B2

(12) United States Patent
Chen

(10) Patent No.: US 12,434,095 B2
(45) Date of Patent: Oct. 7, 2025

(54) STRENGTH TRAINING BRIDGE

(71) Applicant: ANHUI CHAMPION INTELLIGENT MANUFACTURING TECHNOLOGY CO., LTD, Hefei (CN)

(72) Inventor: Zhidong Chen, Hefei (CN)

(73) Assignee: ANHUI CHAMPION INTELLIGENT MANUFACTURING TECHNOLOGY CO., LTD., Hefei (CN)

( * ) Notice: Subject to any disclaimer, the term of this patent is extended or adjusted under 35 U.S.C. 154(b) by 41 days.

(21) Appl. No.: 18/291,878

(22) PCT Filed: Nov. 16, 2021

(86) PCT No.: PCT/CN2021/130795
§ 371 (c)(1),
(2) Date: Jan. 24, 2024

(87) PCT Pub. No.: WO2023/024276
PCT Pub. Date: Mar. 2, 2023

(65) Prior Publication Data

US 2024/0359053 A1 Oct. 31, 2024

(30) Foreign Application Priority Data

Aug. 23, 2021 (CN) ..... 202110969355.1

(51) Int. Cl.
*A63B 23/12* (2006.01)
*A63B 21/00* (2006.01)
(Continued)

(52) U.S. Cl.
CPC ..... *A63B 23/1236* (2013.01); *A63B 21/4035* (2015.10); *A63B 22/16* (2013.01);
(Continued)

(58) Field of Classification Search
CPC . A63B 23/1236; A63B 21/4035; A63B 22/16; A63B 26/003; A63B 71/0054;
(Continued)

(56) References Cited

U.S. PATENT DOCUMENTS 2,494,094 A * 1/1950 Horstman ..... A63B 23/0211 482/128
2,666,640 A * 1/1954 Jennings, Sr. ..... A63B 3/00 482/141
(Continued)

FOREIGN PATENT DOCUMENTS

CN 2231298 Y 7/1996
CN 202157618 U 3/2012
(Continued)

OTHER PUBLICATIONS

International Search Report dated May 23, 2022 for International Application No. PCT/CN2021/130795.

*Primary Examiner* — Garrett K Atkinson

(57) ABSTRACT

The present invention discloses a strength training bridge, comprising: a plurality of module units, wherein each module unit comprises a base; two adjacent module units are arranged along a length direction of the base and are fixedly connected and/or rotatably connected, so that bases of the two module units jointly form an arched structure with a bottom surface protruding downwards. The bridge forms an arched base protruding downwards, wherein the arched structure has seesaw-like instability, and can be used to perform balance training thereon, or the difficulty of related training is increased or targeted training is performed by controlling balance or generating unbalance in the conventional training, so that the training effect is improved. This bridge has a simple overall structure, rich functions and an attractive appearance, which meets the needs of a user for
(Continued)

targeted strength training and is especially suitable for strength training of pectoral muscles and arms.

9 Claims, 5 Drawing Sheets

(51) Int. Cl.
*A63B 22/16* (2006.01)
*A63B 26/00* (2006.01)
*A63B 71/00* (2006.01)

(52) U.S. Cl.
CPC ..... *A63B 26/003* (2013.01); *A63B 71/0054* (2013.01); *A63B 2071/0072* (2013.01); *A63B 2225/09* (2013.01)

(58) Field of Classification Search
CPC ..... A63B 2071/0072; A63B 2225/09; A63B 69/0057; A63B 23/02; A63B 21/4007; A63B 21/4009; A63B 21/4017; A63B 23/129
See application file for complete search history.

(56) References Cited

U.S. PATENT DOCUMENTS 4,822,039 A * 4/1989 Gonzales ..... A63B 21/04 482/130
4,826,151 A * 5/1989 Nuredin ..... A63B 21/4034 482/141
4,900,015 A * 2/1990 Dissinger ..... A63B 23/03533 482/141
5,242,355 A * 9/1993 Costa ..... A63B 21/00047 482/141
5,421,800 A * 6/1995 Mullen ..... A63B 21/00181 482/141
D363,442 S * 10/1995 Mullinix ..... D10/97
5,503,101 A * 4/1996 Mullinix ..... A63B 23/12 116/203
5,582,565 A * 12/1996 Soria ..... A63B 21/00047 482/141
5,643,162 A * 7/1997 Landers ..... A63B 21/4035 482/131
6,120,421 A * 9/2000 Kuo ..... A63B 21/154 482/121
6,129,651 A * 10/2000 Denaro ..... A63B 21/00047 482/141
6,229,764 B1 * 5/2001 Tongue ..... A63B 69/0028 368/110
6,663,547 B1 * 12/2003 Hughes ..... A63B 23/12 482/141
7,052,449 B2 * 5/2006 Chen ..... A63B 22/16 482/142
7,060,014 B2 * 6/2006 Bergman ..... A63B 21/4031 482/141
7,318,793 B2 * 1/2008 Dubrul ..... A63B 23/12 482/141
7,618,358 B2 * 11/2009 Traub ..... A63B 26/003 482/92
7,645,221 B1 * 1/2010 Curry ..... A63B 26/003 482/79
7,803,096 B2 * 9/2010 Mehta ..... A63B 22/14 482/142
7,942,795 B2 * 5/2011 Harris ..... A63B 23/03575 482/142
8,088,052 B1 * 1/2012 Sprague ..... A63B 26/003 482/141
8,998,783 B2 * 4/2015 Orenstein ..... A63B 21/00047 482/141
9,155,934 B2 * 10/2015 Kassel ..... A63B 21/0414
D772,355 S * 11/2016 Orenstein ..... D21/662
10,363,449 B2 * 7/2019 Scott ..... A63B 23/1218
10,463,911 B2 * 11/2019 Chapman ..... A63B 21/0059
10,786,698 B2 * 9/2020 Endemann ..... A63B 21/4035
2004/0102296 A1 * 5/2004 Dubrul ..... A63B 21/4033 482/141
2005/0009677 A1 * 1/2005 Yang ..... A63B 5/11 482/141
2005/0020418 A1 * 1/2005 Lin ..... A63B 21/0552 482/142
2005/0227836 A1 * 10/2005 Wen ..... A63B 21/068 482/141
2005/0245371 A1 * 11/2005 Chen ..... A63B 23/12 482/141
2005/0250628 A1 * 11/2005 Goldstein ..... A63B 21/0552 482/141
2006/0040808 A1 * 2/2006 Riazi ..... A63B 21/00047 482/141
2007/0129226 A1 * 6/2007 Leavitt ..... A63B 23/0458 482/52
2007/0298947 A1 * 12/2007 Eksteen ..... A63B 22/20 482/141
2010/0113225 A1 * 5/2010 Mills ..... A63B 23/1281 482/141
2011/0009250 A1 * 1/2011 Barringer ..... A63B 21/00181 482/141
2011/0160026 A1 * 6/2011 Perez, Jr. ..... A47C 9/002 482/142
2011/0275499 A1 * 11/2011 Eschenbach ..... A63B 21/00181 482/141
2013/0123081 A1 * 5/2013 Boland ..... A63B 21/023 482/141
2013/0190150 A1 * 7/2013 Delisle ..... A63B 21/075 482/141

FOREIGN PATENT DOCUMENTS

CN 103191547 A 7/2013
CN 203169923 U 9/2013
CN 109646885 A 4/2019
CN 111685521 A 9/2020
CN 212307289 U 1/2021
CN 212854486 U 4/2021
CN 213642993 U 7/2021
CN 113616986 A 11/2021
CN 216258940 U 4/2022

* cited by examiner

STRENGTH TRAINING BRIDGE

TECHNICAL FIELD

The present invention relates to the field of sports equipment, and in particular, to a strength training bridge.

BACKGROUND

With the continuous development of society and continuous improvement of the living standard of people, health has become a primary goal of people. Proper physical exercise has also become an effective means for people to improve their health. In the physical exercise, the sports equipment is used for assisting exercise, so that the efficiency of the exercise can be improved, and the scientificity and the safety of the exercise can be increased.

Push-up is a common exercise item, and the push-up fitness equipment can be used for auxiliary exercise. A user can grip the push-up fitness equipment by hands without directly contacting the ground by hands, so that the problem of uncleanness due to contacting the ground by hands is avoided in one aspect, and in another aspect, a posture of the hands is changed, and a push-up action is more scientific. The push-up fitness equipment can be used to exercise pectoral muscles, arm strength and waist strength, and is convenient to use.

However, the existing push-up fitness equipment can only provide a push-up function and has a single function. Therefore, how to implement more functions of monotonous push-up fitness equipment through a special design becomes a problem that needs to be urgently resolved.

SUMMARY

In order to solve the technical problems, the present invention provides a strength training bridge, which forms an arched base protruding downwards, wherein the arched structure has seesaw-like instability, and can be used to perform balance training thereon, or the difficulty of related training is increased or targeted training is performed by controlling balance or generating unbalance in the conventional training, so that the training effect is improved. This strength training bridge has a simple overall structure, rich functions and an attractive appearance, which meets the needs of a user for targeted strength training, and is especially suitable for strength training of pectoral muscles, psoas muscles, and arms.

The technical solutions used by the present invention to solve the technical problems are as follows.

A strength training bridge, comprising: a plurality of module units, wherein each module unit comprises a base; two adjacent module units are arranged along a length direction of the base and are fixedly connected and/or rotatably connected, so that bases of the two module units jointly form an arched structure with a bottom surface protruding downwards.

Further, wherein bases of at least two of the plurality of module units are separately provided with a gripping handle.

Further, wherein the module unit with the gripping handle is detachably connected to adjacent module unit, so that the module unit with the gripping handle is used as push-up fitness equipment after being disassembled.

Further, wherein the strength training bridge comprises two module units, and a base of each module unit is provided with a gripping handle; and bases of the two module units are fixedly connected or rotatably connected through a connection structure.

Further, wherein the connection structure provides a rotatable connecting mode; a pull rope is further connected between gripping handles of the two module units; and the pull rope is used to control a distance between the two grabbing handles and further control an included angle between the two module units.

Further, wherein the connection structure comprises a shaft rod and a shaft sleeve; and the shaft rod and the shaft sleeve are arranged on the respective module units.

Further, wherein the shaft sleeve is provided with an opening for facilitating disassembly and assembly of the shaft sleeve on the shaft rod.

Further, wherein the gripping handle is fixed to the base through a support structure.

Further, wherein the support structure and the base are both configured as a frame structure; and the frame structure has at least one grippable rod portion.

Further, wherein the frame structure is further provided with support surfaces at positions close to two ends of the arched structure in a length direction.

The present invention has the advantages that: the strength training bridge of the present invention forms an arched base protruding downwards, wherein the arched structure has seesaw-like instability, and can be used to perform balance training thereon, or the difficulty of related training is increased or targeted training is performed by controlling balance or generating unbalance in the conventional training, so that the training effect is improved; this arched structure can be disassembled into two independent module units with gripping handles, which is used as push-up fitness equipment, and the arc-shaped design of the base of the module unit is beneficial to enhancing the exercise of the arm strength; the design of the frame structures of the support structure and the base ensures the overall lightweight, and meanwhile, the design of the rod portion for griping improves the stability and the bearing strength of the frame structure in one aspect, and provides a plurality of grippable parts in another aspect, and the angles of the rod portion can be designed to provide different gripping angles, so that a shape from arms to shoulders is changed, and the exercise strength of different muscle groups is further changed. This strength training bridge has a simple overall structure, rich functions and an attractive appearance, which meets the needs of a user for targeted strength training and is especially suitable for strength training of pectoral muscles, psoas muscles and arms and balance training.

DETAILED DESCRIPTION OF EMBODIMENTS

In order to facilitate an understanding of the present invention, the present invention will be further described in detail with reference to accompanying drawings and an embodiment. This embodiment is merely an explanation of the present invention and is not intended to limit the protection scope of the present invention.

Embodiment

Referring to FIGS. 1 to 9, this embodiment provides a strength training bridge, which comprises two module units 1; the two module units 1 are arranged along a length direction of a base 11 and are rotatably connected, so that bases 11 of the two module units 1 jointly form an arched structure with a bottom surface protruding downwards. The arched structure has seesaw-like instability, and can be used to perform balance training thereon, or the difficulty of related training is increased or targeted training is performed by controlling balance or generating unbalance in the conventional training; and a connection structure in a rotatable connection mode has a locking function or an additional locking function is required to keep the two module units 1 relatively fixed through the locking function after relative rotation, so that an included angle between two module units can be adjusted, and the training difficulty can be adjusted.

Of course, the above structure is only a preferred embodiment, and the strength training bridge can also be designed as a plurality of module units 1 (more than two), each module unit 1 comprising a base 11; and two adjacent module units 1 are arranged along a length direction of the base 11 and are fixedly connected and/or rotatably connected. Under the condition of ensuring the bearing strength, the module units can be reasonably disassembled, and a plurality of module units are assembled together; the fixed connection refers to a fixed (unrotatable) connection through a connection member and an integral structure; a plurality of module units forming the same strength training bridge can be in a fixed connection mode, can also be in a rotatable connection mode, and can further be used in a mixture of fixed connection and rotatable connection.

Figure 6:
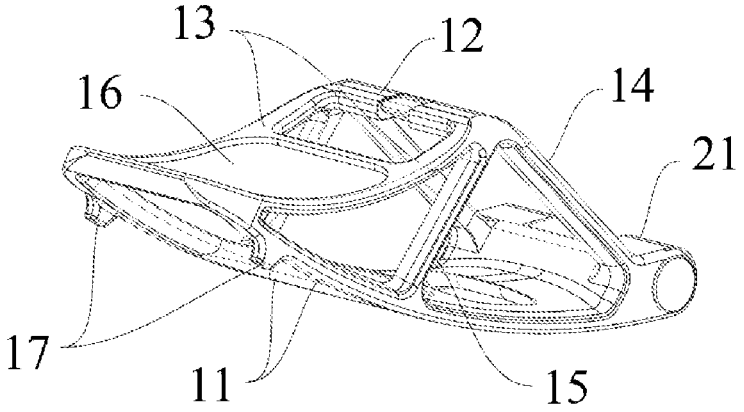
FIG. 6 is a schematic three-dimensional diagram of a module unit of the strength training bridge according to an embodiment.
Figure 7:
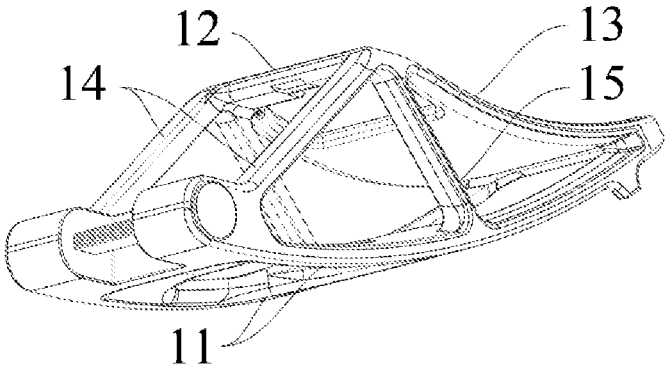
FIG. 7 is a schematic three-dimensional diagram of a module unit of the strength training bridge according to an embodiment from another angle.
Figure 8:
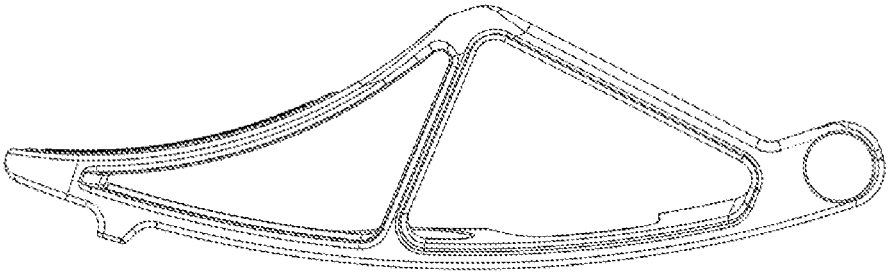
FIG. 8 is a schematic front view of a module unit of the strength training bridge according to an embodiment when used alone.

Further referring to FIGS. 6 and 7, the bases 11 of two module units 1 are separately provided with a gripping handle 12. The design of the gripping handle increases a contact part of the hand with the strength training bridge and provides more training functions. Of course, in addition to the gripping handle 12, two ends of the strength training bridge may also serve as use parts (supporting hands, feet and the like) for the user. Of course, when a plurality of module units (more than two) are used, the bases 11 of at least two module units 1 in the plurality of module units 1 are separately provided with a gripping handle 12 to expand the training function of the strength training bridge.

Figure 5:
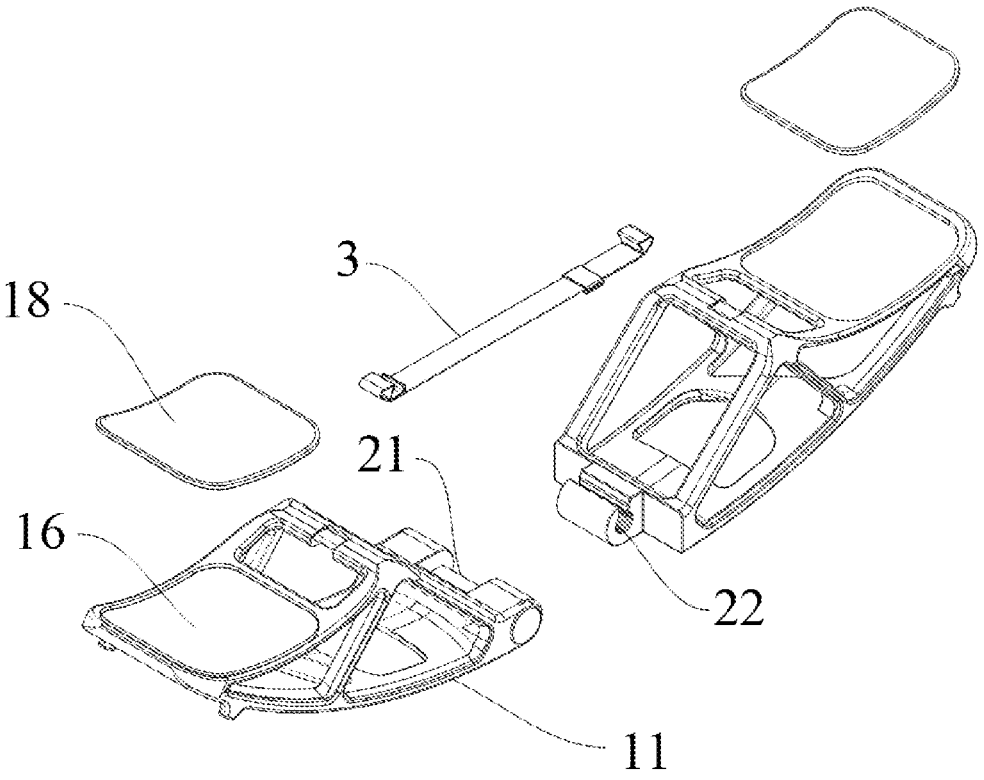
FIG. 5 is a schematic exploded view of a strength training bridge according to an embodiment.

Further referring to FIG. 5, the module unit 1 with the gripping handle 12 is detachably connected to adjacent module unit 1, so that the module unit with the gripping handle 12 is used as push-up fitness equipment after being disassembled. The module unit with the gripping handle 12 can be detached for separate use. It should be noted here that, based on the above arched structure, a corresponding design of the connection structure 2 is positioned at a bottom of the arched structure, the bases of two module units 1 of this embodiment are in mirror image design, and the bottom surfaces of the bases also become an arc shape forming half of the arched shape, so that when the two module units 1 are separately used as push-up fitness equipment, a design of the arc-shaped curved surface of the bottom surfaces of the module units also has unstable characteristics, and the difficulty of push-up can be increased, thereby improving the training effect.

Figure 1:
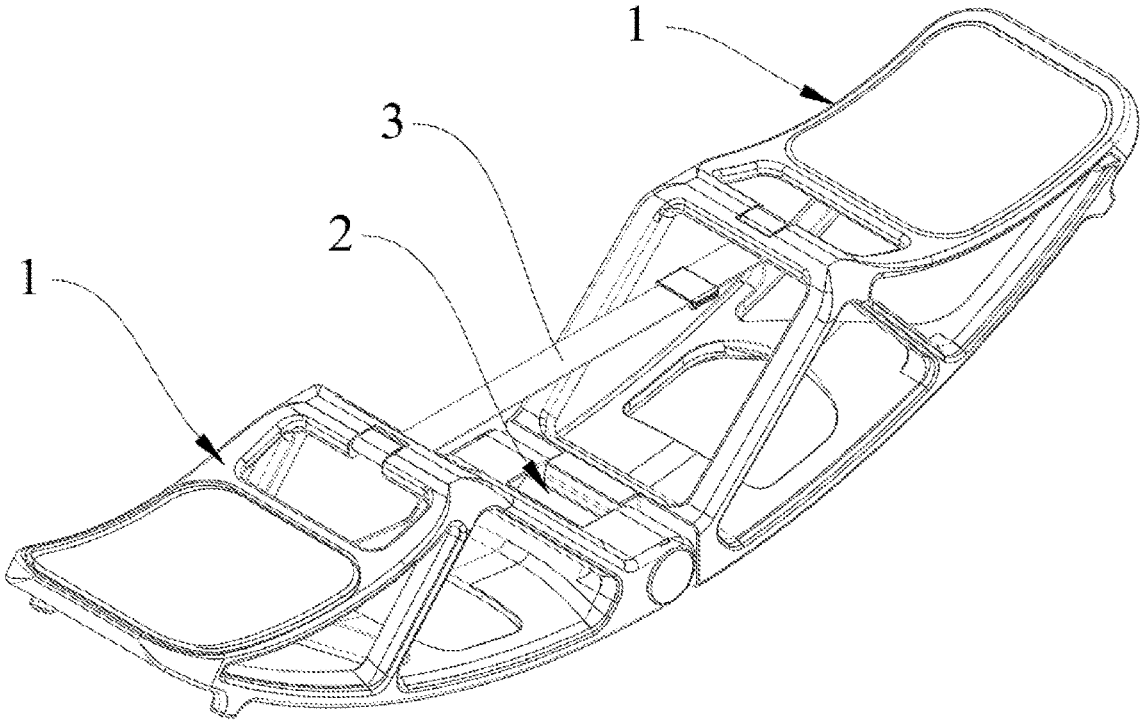
FIG. 1 is a schematic three-dimensional diagram of a strength training bridge according to an embodiment.
Figure 2:
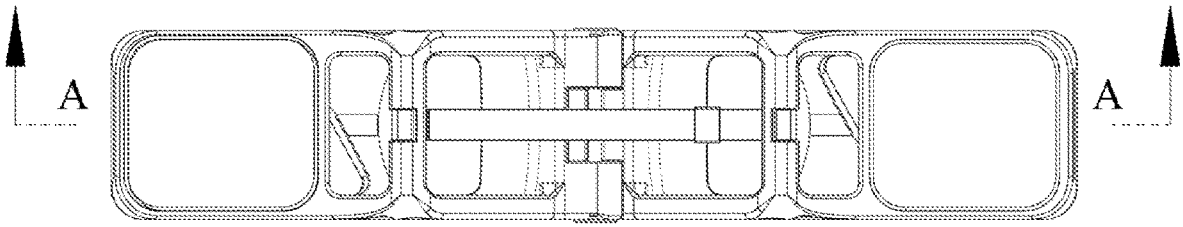
FIG. 2 is a schematic top view of a strength training bridge according to an embodiment.
Figure 3:
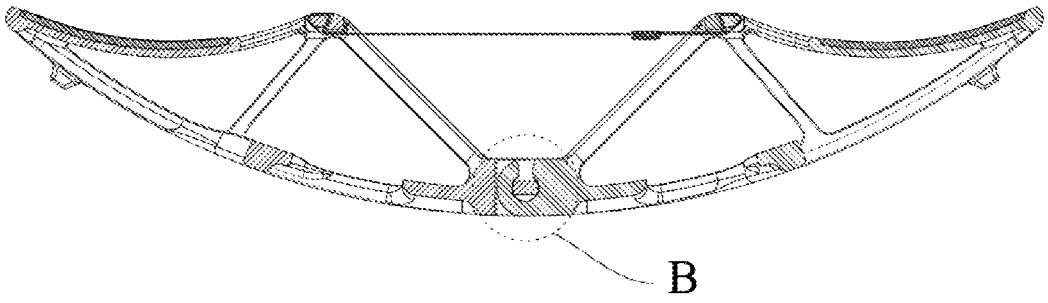
FIG. 3 is a schematic cross-sectional diagram of A-A in FIG. 2.
Figure 9:
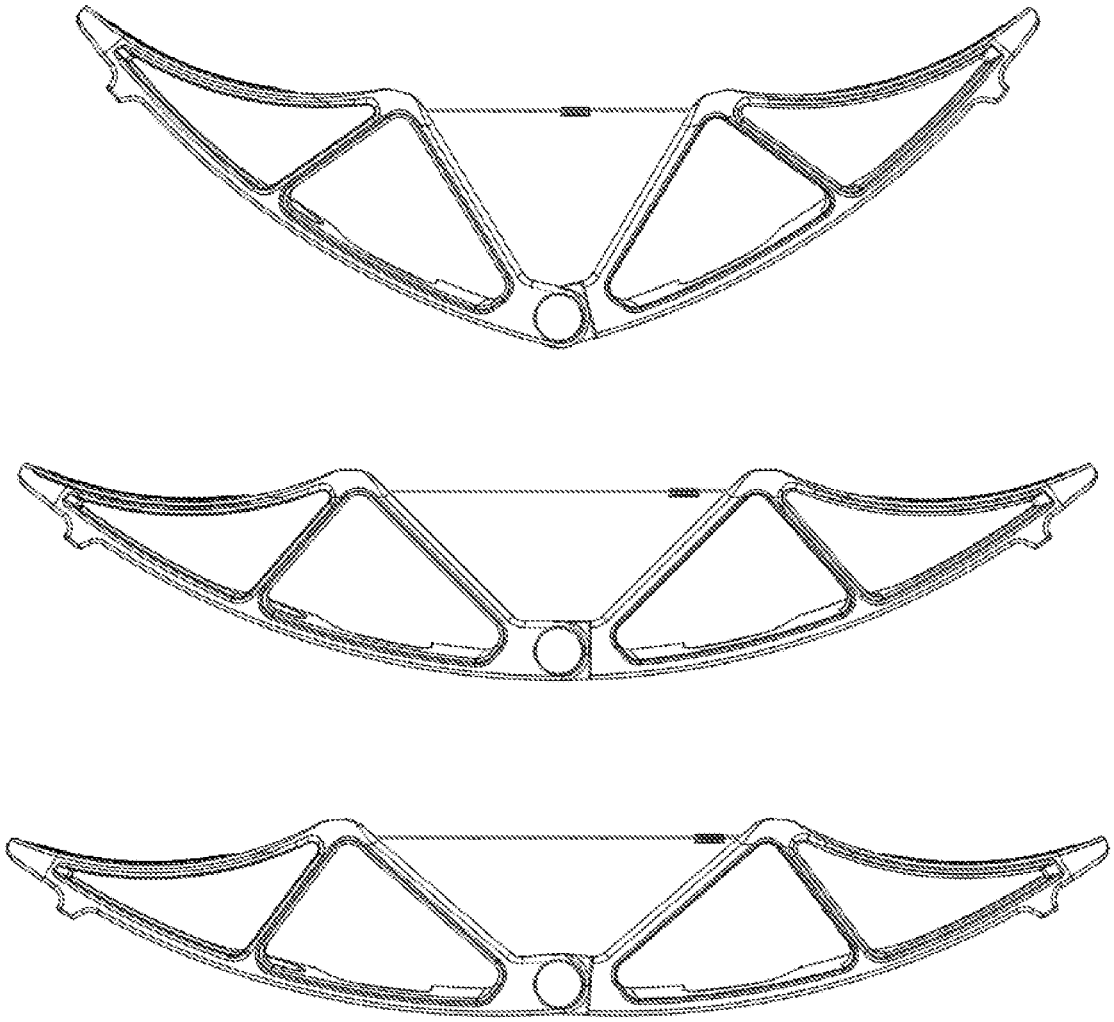
FIG. 9 is a schematic diagram of angle adjustment between two module units of the strength training bridge according to an embodiment; and Reference numerals: 1: module unit, 2: connection structure, 3: pull rope, 11: base, 12: gripping handle, 13: first side edge, 14: second side edge, 15: rod portion, 16: support surface, 17: support leg, 18: pad, 21: shaft rod, 22: shaft sleeve, and 23: opening.

Further referring to FIGS. 1, 3 and 9, a pull rope 3 is further connected between gripping handles 12 of the two module units 1; and the pull rope 3 is used to control a distance between the two grabbing handles 12 and further control an included angle between the two module units 1. The arched structure formed by the bases of the two module units reduces or increases a curvature of a bottom end of the arched structure along with the increase or reduction of an included angle; when the curvature is reduced, the balance is relatively well controlled, and the difficulty of related actions is relatively reduced; when the curvature is increased, the balance is relatively difficult to control, and the difficulty of the related action is relatively increased, and FIG. 9 shows a state when a specific included angle is changed; the use of the pull rope 3 is equivalent to the addition of a locking function to the rotatable connection structure; when this product is in actual use, the included angle can be properly adjusted through the pull rope according to an actual requirement, so that the best training effect can be achieved; in addition, the combination of the pull rope 3 and the rotatable connection structure 2 may be replaced by other structures, which need to consider a strength of the connection, and other structures such as a connection by a spline and a key groove may be used to meet the strength requirement (corresponding to the rotatable connection structure having a locking function).

Figure 4:
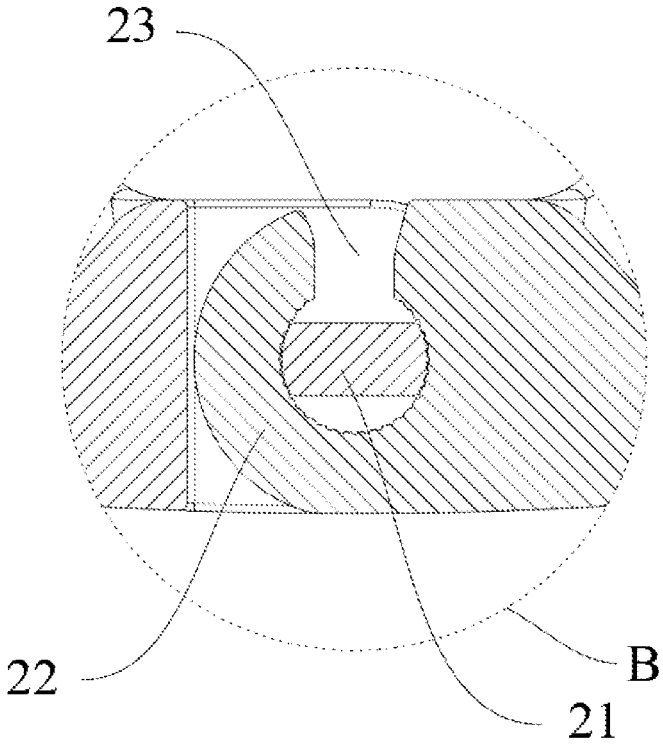
FIG. 4 is a partially enlarged schematic diagram of B in FIG. 3.

Further referring to FIGS. 3 and 4, the connection structure 2 comprises a shaft rod 21 and a shaft sleeve 22; the shaft rod 21 and the shaft sleeve 22 are arranged on the respective module unit 1; and the shaft sleeve 22 is provided with an opening 23 for facilitating the assembly and disassembly of the shaft sleeve 22 on the shaft rod 21. Specifically, a cross section of the shaft rod 21 perpendicular to a length direction (axial direction) is configured as a rectangle-like shape, and the rectangle-like shape has a pair of parallel straight edges and a pair of arc-shaped line segments positioned on the same circle; a minimum size of the opening only needs to be slightly greater than a vertical distance between the pair of parallel straight edges, so that the shaft rod 21 can enter the shaft sleeve 22 through the opening 23, and meanwhile, the shaft rod 21 is matched with an inner wall of the shaft sleeve 22 through a surface corresponding to the arc-shaped line segment, so that the function of rotating the shaft rod 21 in the shaft sleeve 22 is ensured. In addition, shallow grooves distributed along an axial direction of the shaft sleeve 22 are formed on the inner wall of the shaft sleeve; the shaft rod 21 is provided with semicircular convex edges along the axial direction on a surface corresponding to the arc-shaped line segment, which then cooperates with the shallow grooves, so that the rotating resistance is increased between the shaft rod 21 and the shaft sleeve 22, the sliding between the shaft sleeve 22 and the shaft rod 21 is reduced, the length of the pull rope is adjusted, and after the included angle between the two module units is fixed, the stability of the shaft sleeve 22 and the shaft rod 21 can be improved through the design of the shallow grooves and the convex edges. In addition, a surface corresponding to the straight edge of the shaft rod 21 is designed to be substantially horizontal, and the opening direction of the opening is upward or downward, so that the shaft sleeve 22 can be sleeved on the shaft rod 21 through the opening at an angle that the two module units are not used, and the shaft sleeve 22 and the shaft rod 21 are in a rotating fit state under an angle that the two module units are commonly used, so that the shaft rod 21 cannot be pulled out from the opening of the shaft sleeve 22. Of course, the connection structure can use other modes as long as the included angle between the two module units can be adjusted, and the connection mode increases the function of quick assembly and disassembly based on rotation.

In the strength training bridge according to this embodiment, the gripping handle 12 is fixed to the base 11 through a support structure. The support structure can be in various forms as long as the gripping handle is fixed on the base 11, and the support structure, the gripping handle and the base can be integrated or assembled.

Further referring to FIGS. 5 to 8, the support structure and the base are both configured as a frame structure; and the frame structure has at least one grippable rod portion. Specifically, the frame structure of the base is an arched frame, which has parallel straight edges at left and right sides and arc-shaped curved edges at front and rear sides (for convenience of illustration and clear description of a corresponding structure, a length direction of the arched frame is defined as left and right directions); a plurality of rod portions can be arranged in the frame, and the plurality of rod portions may or may not be parallel to the two straight edges, so that the stability of the base is enhanced in one aspect, and the gripping function is provided in another aspect; various angles between the rod portion and the length direction of the arched frame can provide various gripping angles, and of course, only a rod portion for the most basic gripping can be provided, and the rod portion can be designed according to an actual requirement; a frame structure of the support structure has a first side edge 13 and a second side edge 14 that are arranged at front/rear ends of the gripping handle and that are connected to two ends of the corresponding front/rear curved edges of the base, respectively, and the frame structure of the support structure further comprises a rod portion 15 that is arranged at the front/rear ends of the gripping handle and that is close to a middle position of the corresponding front/rear curved edges of the base; of course, a structure similar to the rod portion 15 may also be designed in multiple manner, so that a plurality of rod portions for gripping are provided at the front and rear sides of the support structure, and meanwhile, the stability of the support structure is also enhanced. Based on the above description, reasonable design can be performed according to an actual requirement, for example, the position where two ends of the rod portion are connected and the formed gripping angle can be properly adjusted, as long as the module unit is stable in structure, reasonable in stress, good in bearing capacity and light in weight.

Further referring to FIG. 5, the frame structure is further provided with support surfaces 16 at positions close to two ends of the arched structure in a length direction. The support surface is used to support forearms of a user when the user performs plank exercise; and a pad 18 is also provided on the support surface 16 to improve the anti-slip safety and comfort of the user. Specifically, in this embodiment, taking a module unit at a left side as an example (a structure of a module unit at a right side and a module unit at a left side, except for the connection structure, is a mirror image structure), a first side edge is defined as being at a left side, the first side edge is configured as an arc-shaped structure protruding downwards, an arc-shaped curved surface structure is formed between two first side edges, a top surface of the curved surface structure is the support surface 16, and the arc-shaped curved surface structure protruding downwards better meets a support requirement of the user on the forearms when the user performs a plank action.

The strength training bridge according to this embodiment has two states of integral use and separate use, and can be used for a variety of trainings, specifically as follows:

Integral Use State:

A. the strength training bridge is placed in a mode that a protruding part of the arched structure contacts the ground, and can be used for training as follows:

A1. unstable plank training: according to a normal plank posture, a user supports forearms on the support surfaces at two ends of the strength training bridge, and due to the instability of the arched structure, the user needs to use more muscle strength to maintain balance on the basis of maintaining the plank action, so that the strength training effect is better than that of the conventional plank, and in addition, a distance between two arms and a curvature of the arched structure can be controlled by adjusting an included angle between two module units, so as to control the training difficulty;

A2. unstable push-up training: according to a normal push-up posture, a user supports or grips the strength training bridge, and due to the instability of the arched structure, the user needs to use more muscle strength to maintain balance on the basis of maintaining the push-up action, so that the strength training effect is better than that of the conventional push-up; specifically, the training difficulty can be controlled by a position where the user grips, for example, when the user grips two ends of the strength training bridge, the conventional push-up training can be performed, when the user grips a gripping handle, the narrow-arm push-up training can be performed, and of course, a distance between two hands and a curvature of the arched structure can be adjusted by adjusting an included angle between two module units, so as to control the training difficulty;

A3. high-low push-up training: compared with the push-up training in A2, the high-low push-up training increases the difficulty of creating unbalance, is more difficult to control balance compared with A2, and can perform training aiming at uneven left and right strength; in addition, in the high-low push-up training, when the hands grip two ends of the strength training bridge, in order to prevent the strength training bridge from pressing on the hands when deflecting, a support leg 17 is arranged at a position that is of the arc-shaped curved edge of the frame structure of the base and that is close to one end opposite to a connection, and the support leg can enable a straight edge of the frame structure at the end to keep a distance from the ground when the strength training bridge deflects to a maximum angle;

A4. standing balance training: the feet step on two ends of the strength training bridge, seesaw-like balance training can be performed, and it is not recommended to adjust an included angle between two module units too small during this process;

B. a side surface of the arched structure of the strength training bridge contacts the ground, so that push-up training can be performed, and in this case, an angle design of the rod portion on the side surface of the arched structure can ensure that the wrist of a user turns outwards or inwards when the user performs push-up (one side surface of the strength training bridge faces upwards to provide an inwards function, and the other side surface of the strength training bridge faces upwards to provide an outwards function), so that a shape from arms to shoulders is changed, and the exercise strength of different muscle groups is further changed;

C. in addition, when the protruding part of the arched structure is placed upwards, corresponding push-up training can be performed.

The strength training bridge according to this embodiment can be used from all sides, which is very convenient.

Separate Use State:

D. the two module units are disassembled to be used as separate push-up fitness equipment;

D1. the arc-shaped curved surfaces of the bottom plates of the two module units contact the ground, and the function is similar to that of the A2, so that the difficulty of maintaining balance can be increased based on conventional push-up training, and the training intensity of wrist strength can be increased; in addition, compared with the integral state, the separated module units can provide a wider distance for wide-arm push-up training; moreover, the support leg 17 can prevent the base from excessively deflecting to cause injury to the wrist;

D2. when the side surfaces of two module units contact the ground, conventional push-up training can be performed.

The strength training bridge according to this embodiment forms an arched base protruding downwards, wherein the arched structure has seesaw-like instability, and can be used to perform balance training thereon, or the difficulty of related training is increased or targeted training is performed by controlling balance or generating unbalance in the conventional training, so that the training effect is improved; this arched structure can be disassembled into two independent module units with gripping handles, which is used as push-up fitness equipment, and the arc-shaped design of the base of the module unit is beneficial to enhancing the exercise of the arm strength; the design of the frame structures of the support structure and the base ensures the overall lightweight, and meanwhile, the design of the rod portion for griping improves the stability and the bearing strength of the frame structure in one aspect, and provides a plurality of grippable parts in another aspect, and the angles of the rod portion can be designed to provide different gripping angles, so that a shape from arms to shoulders is changed, and the exercise strength of different muscle groups is further changed. This strength training bridge has a simple overall structure, rich functions and attractive appearance, which meets the needs of a user for targeted strength training, and is especially suitable for strength training of pectoral muscles, psoas muscles and arms and balance training.

The above embodiments should not limit the present invention in any way, and all technical solutions obtained by using equivalent substitution or equivalent conversion shall fall within the protection scope of the present invention.

The invention claimed is:

1. A strength training bridge, comprising: two module units, wherein each module unit comprises a base, a frame structure of the base is an arched frame, which has parallel straight edges at left and right sides and arc-shaped curved edges at front and rear sides; the two module units are arranged along a length direction of the base and are rotatably connected, so that the bases of the two module units jointly form an arched structure with a bottom surface protruding downwards, a length direction of the arched frame is defined as left and right directions; the two module units are rotatably connected through a connection structure, the connection structure has a locking function to keep the two module units relatively fixed through the locking function after relative rotation, so that an included angle between the two module units can be adjusted.

2. The strength training bridge according to claim 1, wherein the bases of the two module units are separately provided with a gripping handle.

3. The strength training bridge according to claim 2, wherein the two module units are detachably connected to each other and are configured to be used as push-up fitness equipment after being disassembled.

4. The strength training bridge according to claim 2, wherein the connection structure provides a rotatable connecting mode; a pull rope is further connected between gripping handles of the two module units; and the pull rope is used to control a distance between the gripping handles and further control an included angle between the two module units.

5. The strength training bridge according to claim 2, wherein the connection structure comprises a shaft rod and a shaft sleeve; and the shaft rod and the shaft sleeve are arranged on the respective module units.

6. The strength training bridge according to claim 5, wherein the shaft sleeve is provided with an opening for facilitating disassembly and assembly of the shaft sleeve on the shaft rod.

7. The strength training bridge according to claim 2, wherein both gripping handles are respectively fixed to the bases of the two module units through corresponding support structures.

8. The strength training bridge according to claim 7, wherein each of the bases comprises a support structure configured as a frame structure, and each frame structure includes at least one grippable rod portion that is part of the frame structure itself and is distinct from the gripping handle.

9. The strength training bridge according to claim 8, wherein each of the frame structures of the bases is further provided with support surfaces at positions close to two ends of the arched structure in a length direction.

* * * * *